United States Patent [19]

Hyler

[11] 3,934,362

[45] Jan. 27, 1976

[54] ELEVATING-TYPE SCRAPER HAVING FORWARDLY SWINGABLE FLOOR SECTION

[75] Inventor: John H. Hyler, Peoria, Ill.

[73] Assignee: Westinghouse Air Brake Company, Pittsburgh, Pa.

[22] Filed: Nov. 15, 1974

[21] Appl. No.: 523,968

[52] U.S. Cl. ..... 37/8; 37/126 R
[51] Int. Cl.[2] ..... B60P 1/36
[58] Field of Search ..... 37/8, 126, 129

[56] References Cited

UNITED STATES PATENTS

| | | | |
|---|---|---|---|
| 2,650,440 | 9/1953 | Quartullo | 37/126 R |
| 3,208,165 | 9/1965 | Johnson et al. | 37/8 |
| 3,343,286 | 9/1967 | Ray, Jr. et al. | 37/8 |
| 3,564,737 | 2/1971 | Simmons et al. | 37/8 |
| 3,680,234 | 8/1972 | Scott | 37/8 X |

*Primary Examiner*—Stephen C. Pellegrino
*Attorney, Agent, or Firm*—Wolfe, Hubbard, Leydig, Voit & Osann, Ltd.

[57] ABSTRACT

An elevating type scraper for earthmoving purposes having an open-fronted bowl with a scraper blade along the leading edge and with a rearwardly inclined elevator for sweeping the loosened soil from the blade into the bowl, the back of the bowl and the base of the blade being fixed to the bowl. The bottom of the bowl is enclosed by front and rear floor members, each of the floor members having a pair of side plates which are pivoted within the sides of the bowl so that each floor member is pendulously supported for fore-and-aft swinging movement about a transversely extending axis. An actuating means is provided for swinging the floor members between the normally closed, or collecting, position and the open position for dumping the contents of the bowl. A striker blade associated with the front edge of the rear floor member, and which projects downwardly from the bowl when such floor member is in its open position, serves to level the material dumped from the bowl. Preferably the front floor member is substantially larger in size than the rear floor member so that when the two are thrust apart by an actuator arranged between them, the rear floor member responds first, to place the striker blade in active position prior to opening of the front floor member. Forwardly extending lateral brackets on the front floor member engage the elevator frame so that when the floor member is swung toward its open position, the elevator is swung forwardly and upwardly to accommodate the floor member and, at the same time, to disengage the elevator flights from the contained soil. In an alternate embodiment the front floor member is centrally notched to define wings which straddle the elevator.

23 Claims, 11 Drawing Figures

ELEVATING-TYPE SCRAPER HAVING FORWARDLY SWINGABLE FLOOR SECTION

BACKGROUND OF THE INVENTION

The invention relates generally to an earthmoving device in the form of a tractor-drawn scraper having a bowl into which the loosened soil is propelled by an elevator and which has improved means for dumping when the bowl is filled.

When operating under wet conditions in clayey soils the soil which is collected in the scraper bowl is not easily dislodged. It has been the practice in the past to employ a floor having a fixed rear section and a sliding front section which is shifted rearwardly to provide a discharge opening. The rear wall of the bowl is commonly in the form of an ejector plate which is thrust forwardly by actuators to push the soil into a position over the front opening. The effect of the ejector plate is often to compact the soil into a tight mass which becomes firmly stuck to the side sheets of the bowl and tightly jammed into the flights of the elevator, both effects, combined with the relatively small area of the opening, tending to cause the soil to become "hung up" in the bowl. Moreover, it is found that when using bowls having a length which is greater than the width dimension, the tendency of the mass of soil to expand outwardly toward the side walls, in the case of clayey soils, produces a bracing effect which may be sufficient to block the ejector plate against further forward movement. Thus while conventional elevator type scrapers work very well in soils which are relatively dry and friable it is sometimes necessary, in the case of wet clayey soils, to suspend operations until the soil loses some of its moisture, which is both disruptive and costly.

Moreover, in the usual design of a sliding front floor section the section has rollers which are fitted in tracks or on rails formed at the lower edges of the bowl side sheets, in close proximity to the ground. In such vulnerable position the tracks are susceptible to clogging with clay, rocks or debris and to damage from boulders and the like. Moreover, because of the wide spacing between the tracks, there is a cocking tendency when more resistance is encountered on one side of the floor section than on the other. The actuators which operate the slidable floor section must be positioned low in the structure so that the forces which they apply are in line with the resistance, and such low positioning makes these devices, too, subject to damage and malfunction.

Because of the necessity for sliding the front floor section under the rear, fixed, floor section while achieving the necessary ground clearance, the fixed floor section must be located relatively high off the ground, which results in a sacrifice in carrying capacity and which tends to raise the center of gravity.

It is, moreover, a common expedient in devices of this type to mount the scraper blade at the front edge of the slidable floor section so that it, upon retraction, may also serve as a spreader or strike-off device. However, the modern tendency to use relatively narrow scraper blades with projecting ripper teeth to engage the subsoil precludes smooth, full-width strike-off or leveling. Also, when the scraper blade is mounted on the forward edge of a slidable floor section, the floor section and its mounting must be made quite massive in order to absorb reaction forces, but without imparting any strength to the bowl structure. Then too, where an ejector plate is used in lieu of a back wall, the side sheets do not have back wall for lateral bracing so that the bowl lacks reinforcement at the back as well as at the front. To this must be added the fact that, where an ejector plate is used, provision must be made behind the plate, and between the rear wheels, for relatively massive actuators and actuator mounting elements which, in the case of a scraper having a rear engine, results in serious space and design complications.

SUMMARY OF THE INVENTION

It is, accordingly, an object of the present invention to provide a floor structure for a scraper which is of simple trouble-free construction and which easily and quickly makes available for dumping purposes substantially the entire bottom area of the bowl for immediate discharge of the contained load even where such load consists of wet, clayey soil and which, in addition, spreads and levels the discharged material evenly across the entire bowl width. It is a general object of the present invention to overcome the various disadvantages which have been associated with prior constructions.

It is another object to provide, in an elevator type scraper, a floor assembly which not only facilitates dumping of difficult materials but which accomplishes this aim using a construction which is inherently inexpensive and trouble free.

This is accomplished using a bowl having a rigid rear or back wall and a fixed blade base, with the bowl being enclosed at the bottom by a front floor member and a rear floor member arranged edge to edge in substantially the same plane, each of the floor members extending transversely so as to bridge the space between the side sheets. Each of the floor members is provided with a pair of integral side plates which are positioned along the inside surfaces of the respective bowl side sheets and which are respectively pivoted to the side sheets for pendulous fore-and-aft swinging movement about a transversely extending axis. The front pivot means is so located that when the front floor member is swung forwardly to open position it nests, in a generally vertical position, adjacent the lower end of the elevator. The rear pivot means is so located that when the rear floor member is swung rearwardly to open position it nests in a generally vertical position adjacent the rear wall of the bowl, with the result that substantially the entire bottom area of the bowl is available for dumping. Movement of the floor members is obtained by interposing, between the adjacent side plates, an actuator for thrusting the floor members apart and for drawing them back together again. The rear floor member is provided with a straight striker blade at its front edge, extending the width of the bowl, and projecting downwardly from the bowl to a strike-off position for smoothly leveling the material as it is dumped from the bowl.

In one of the aspects of the invention the front floor member, as it is swung to open position, engages the elevator to swing it out of the way and, at the same time, to disengage the elevator from the material in the bowl so that the material is free to dump.

Because of the pendulous mounting of the floor members and the lack of need for tracks and rollers, structural tolerances may be made quite liberal and there is little risk that a floor member will be prevented from opening or prevented from returning to closed position because of the wedging effect of the soil or foreign object, and the problem of jamming due to cocking, in either direction of movement, is completely eliminated.

DETAILED DESCRIPTION OF THE PREFERRED EMBODIMENT

Figure 1:
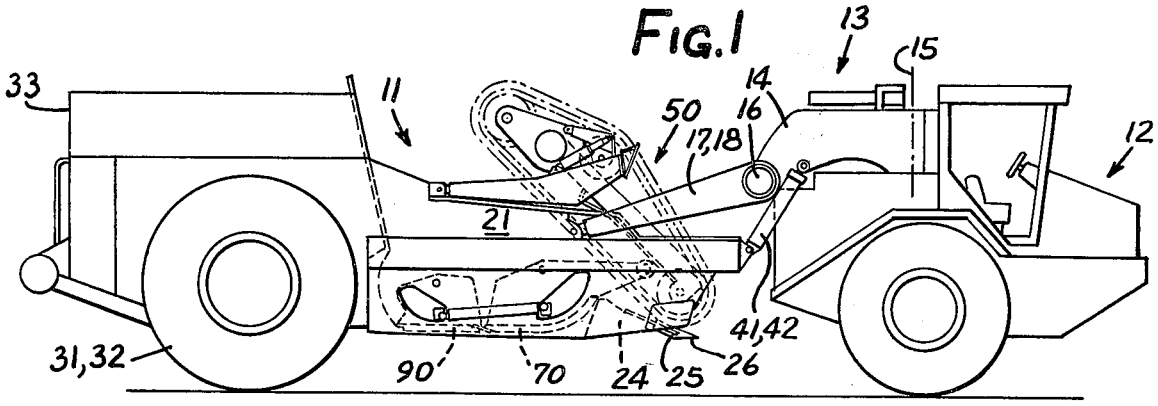
FIG. 1 is a side elevation of a complete elevating scraper assembly, including tractor, to which the present invention has been applied.

Referring now to the drawings there is disclosed a scraper assembly having a bowl 11 and tractor 12 interconnected by a draft frame 13. The draft frame includes a so-called gooseneck 14 which is of rigid construction pivoted to the tractor at 15 for horizontal swinging movement and carrying a torque tube 16, to the lateral ends of which are rigidly secured draft members 17, 18.

The bowl includes a pair of side sheets 21, 22 which are interconnected by a back wall 23. At the front the side sheets are interconnected by a blade base 24 which mounts a cutter blade 25 with ripper teeth 26. The bowl has an open front occupied by an elevator to which reference will be made.

The rear end of the bowl structure is supported upon rubber tired wheels 31, 32 driven by an engine 33 mounted between them. The forward portion of the bowl is supported by pivotal engagement, at 37, 38, with the rear ends of the draft members 17, 18. The tilt of the bowl and running level of the blade is controlled by bowl supporting actuators 41, 42, also referred to as bowl hoist cylinders, which are interconnected between the ends of the torque tube and the front corners of the bowl structure. By extending the actuators 41, 42, the bowl is rocked clockwise, as viewed in FIG. 1, lowering the scraper blade 25 to a desired depth of cut.

Mounted transversely at the open front end of the bowl is an elevator 50 having spaced frame members 51, 52 which occupy a rearwardly inclined position. Extending between the members 51, 52 is a top drive shaft 53 having sprocket wheels 55, 56. The shaft 53 is rotated by a motor M having a gear box 54. In alined position at the lower end of the elevator frame are rollers 57, 58, with additional support being provided by idler rollers 59, 60. Engaging the sprockets and trained about the rollers are respective conveyor chains 61, 62 having soil engaging flights 63.

It will be apparent, then, that as motor M is rotated, the underside of the elevator engages the soil which has been scalped and loosened by the blade 25, propelling it into the bowl. To permit upward swinging movement of the elevator, the elevator is mounted on a pair of arms 65, 66 pivoted to the side sheets upon pivots 67, 68. This not only enables the elevator to yield upon picking up a boulder or other obstruction but permits the elevator to be intentionally disengaged from the contained soil for free dumping of the latter as will be described.

In accordance with the invention a front floor member 70 is provided which extends transversely to bridge the space between the bowl side sheets and which is fitted with sideplates 71, 72 to form a cradle, the side plates being spaced from the sheets by a clearance dimension. The plates 71, 72, which are generally of sector shape, are pivoted to the side sheets by pivot pins 73, 74 which are alined with one another along a transverse axis 75. The pins 73, 74 mount the floor member 70 for pendulous swinging movement, the pivot axis being so located that the floor member 70 may be swung from the closed operating position illustrated in FIG. 5 to the open, substantially vertical position illustrated in FIG. 6 in which the floor member nests closely adjacent the elevator. For the purpose of insuring that there is no interference with the elevator, and particularly with the catenary of the elevator chain, the floor member is provided with forwardly extending brackets 77 78 having rollers 79, 80 thereon which engage tracks 81, 82 on the respective elevator frame members. The rollers perform the function of cams while the tracks serve as cam followers. Thus when the floor member 70 is swung forwardly, by means to be described, the rollers 79, 80, engaging the tracks, cause the elevator to swing about its virtual center 67 into an upraised position. This not only serves to accommodate the floor member in its vertical position, but disengages or "unlocks," the flights from the soil which is packed in the bowl. When the floor member 70 is swung back to its operating position the elevator follows, by force of gravity, back into its own operating position.

Further in accordance with the invention a rear floor member 90, also of cradle construction, is provided having sector-like side plates 91, 92 with pivot pins 93, 94 for pinning the same to the respective bowl side sheets alined along an axis 95. Extending along the front edge of the rear floor member, bolted to it, and substantially the complete width of the bowl, is a striker blade 96. The floor member 90 normally occupies the position illustrated in FIG. 5. When the scraper is in its dumping mode the rear floor member 90 is swung upwardly and rearwardly into a substantially vertical position as illustrated in FIG. 6 in which the striker blade 96 extends downwardly from the bowl and in which the floor member 90 is seated upon a stop surface 97 which extends transversely along the rear edge of the bowl serving as a bottoming stop to provide a proper striking angle. The stop is located sufficiently low as to directly absorb the forces which may be exerted upon the striker blade as it performs its striking and leveling function or which may result from impact with a boulder or other obstruction. The back wall of the bowl is arcuately profiled at 28, about the axis 95 so that it is scraped clean when the floor member 90 is rotated to dumping position.

While the floor members 70, 90 may be operated by individual actuators, it is one of the features of the present construction that both floor members are operated by the same pair of actuators interposed between them. Further in accordance with the invention the actuators which operate the floor sections are floatingly mounted along the outside surfaces of the bowl side sheets, with the ends of the actuators being coupled to blocks which are secured to the floor side plates and which project through arcuate clearance openings in the side sheets. Thus an actuator 110 is provided having connections 111, 112 to blocks 113, 114 which are mounted upon side plates 71, 91 and which extend through clearance openings 115, 116 in the side sheet 21. At the other side of the bowl a similar actuator 120 having connections 121, 122 is connected by blocks 123, 124 to adjacent end plates via clearance openings 125, 126.

Figure 8:
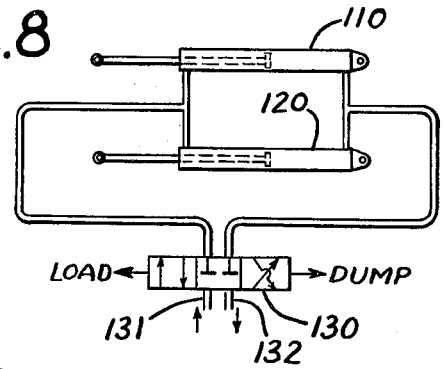
FIG. 8 is a simplified hydraulic control diagram.

The hydraulic system used for supplying the actuators 110, 120 may be of rudimentary form, as illustrated in FIG. 8, employing a valve 130, diagrammatically illustrated as being of the slide type, fed by a pressure line 131 and exhausted by a sump line 132. Moving the valve to its extreme positions causes the actuators 110, 120 to expand and contract for opening and closing the floor members. The same type of circuit may be used to control actuators 41, 42.

Figure 5:
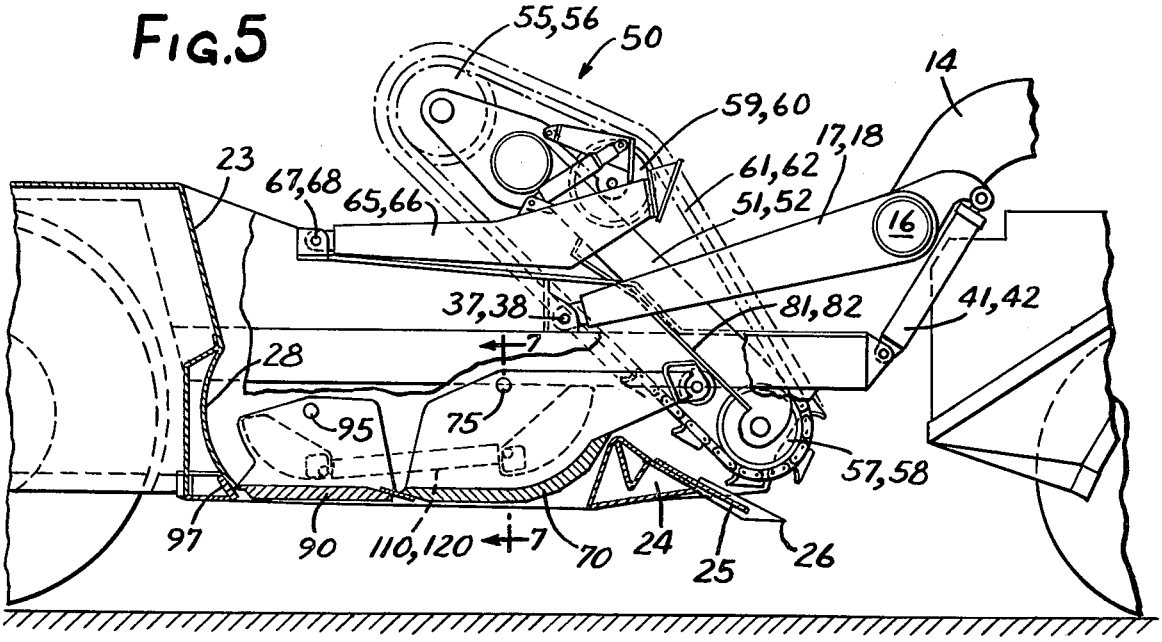
FIG. 5 is a longitudinal section taken through the bowl showing the floor members in closed condition.
Figure 6:
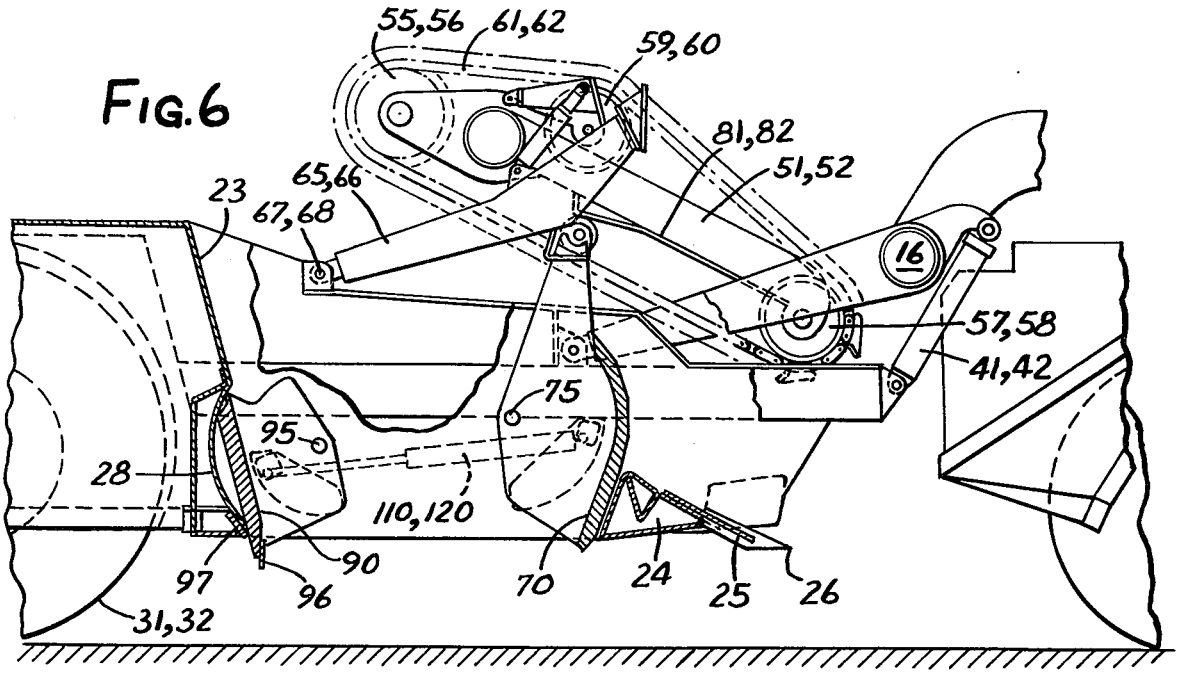
FIG. 6 is a view similar to FIG. 5 but showing the floor members in open condition and elevator upraised.

In a typical operating sequence, with the actuators 110, 120 fully contracted, and with the floor members closed as illustrated in FIG. 5, the tractor draws the bowl in scalping engagement with the ground. The elevator, driven by the motor M, engages the loosened soil and propels it rearwardly with a sweeping action into the bowl until the bowl is filled. The actuators 41, 42 (FIG. 1) are thereupon contracted to raise the blade out of engagement with the ground, and the tractor is driven to the dumping area. During such travel the flights of the elevator retain the soil in place and prevent leakage.

Upon arrival at the dumping area valve 130 is operated to expand the floor actuators 110, 120 which sequentially move the floor members, first rocking the rear floor member 90 from the position shown in FIG. 5 to the position illustrated in FIG. 6 so that the striker blade 96 extends to the desired striking angle and level below the bowl. After the floor member 90 bottoms on the stop 97, the floor member 70 is rocked forwardly and upwardly into vertical position with the entire bottom of the bowl thus being open for dumping purposes. It is to be noted that since the floor member 90, which is relatively smaller than the floor member 70, and thus offers lesser resistance, is first moved to striking position, all of the soil which escapes from the bottom of the bowl is certain to be acted upon by the blade 96. Because of the large area, and the fact that the collected soil is unsupported, it tends to flow by gravity out of the opening.

Figure 4:
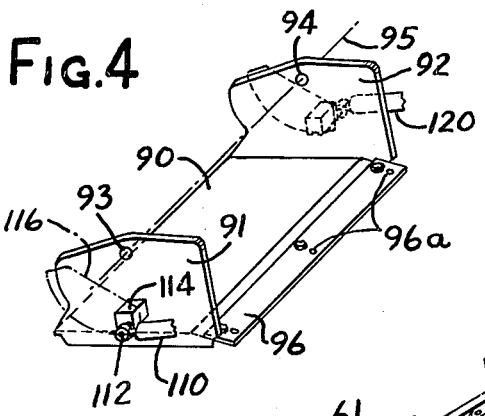
FIG. 4 is a perspective view of the rear floor member.
Figure 2:
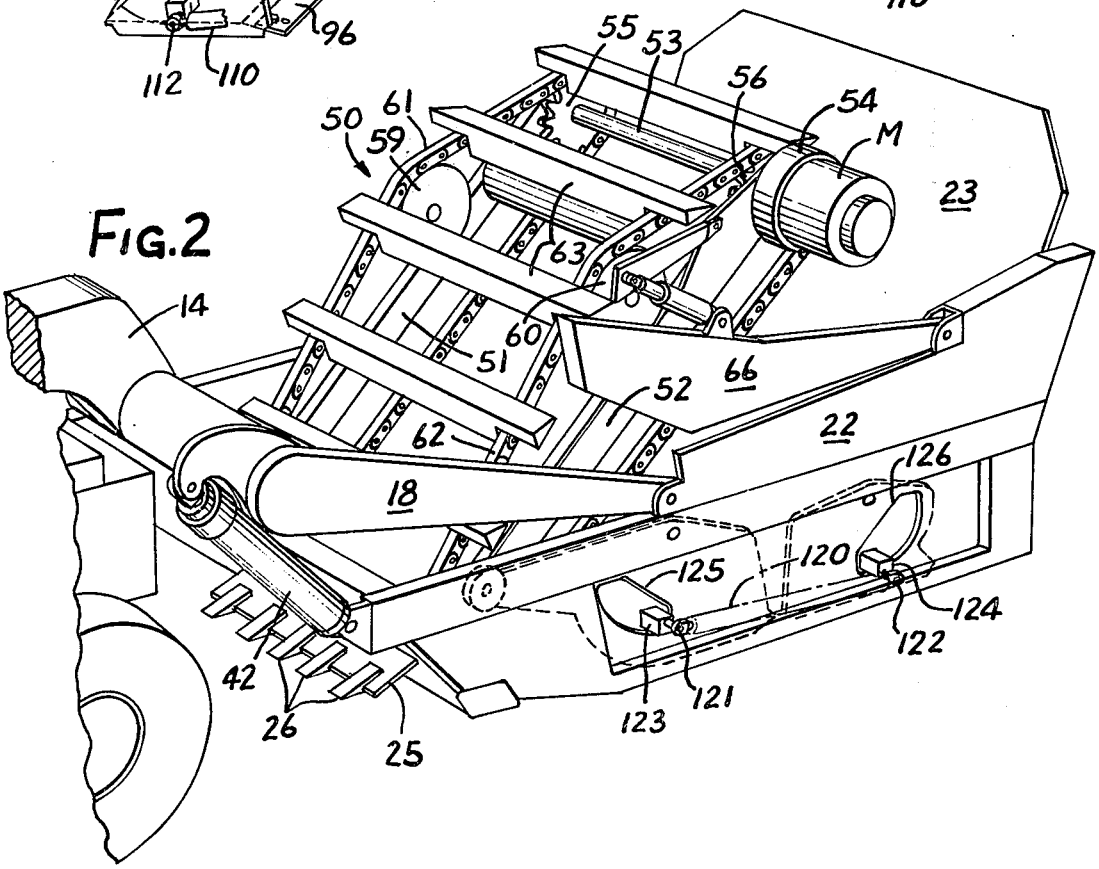
FIG. 2 is a fragmentary perspective of the bowl and elevator.

Even wet, clayey soils are promptly discharged. This is encouraged by the fact that the front floor member 70, by reason of the rollers 79, 80 thereon, lifts the elevator to an upraised position clear of the soil. Moreover, the rocking movement of the side plates 71, 72 and 91, 92 of the floor members produces a shearing action over a large region of engagement of the soil with the side sheets of the bowl, thus breaking any grip that clayey soil may have upon the side sheets and enabling the mass of soil to fall clear of the bowl, free of the effects of endwise compaction. The mass is broken up by engagement with the surface of the ground and, finally, leveled evenly and in full width by the striker blade. Because the striker blade is located at the rear of the bowl and closely adjacent the rear supporting wheels, such wheels act as gauge wheels. Changes in the gauged depth of spread may be made by forming the blade with one or more additional sets of bolt holes 96*a* (FIG. 4).

When discharge is complete, the valve 130 is moved in the opposite direction to contract the actuators 110, 120 to close the floor members with a reverse sequential movement. That is, the front floor member 70, being of greater weight, and being subjected in addition to the weight of the elevator, closes first, with the rear floor member 90 closing last to insure that the striker blade remains in position as long as any soil is being dumped.

ALTERNATE EMBODIMENTS

Figure 9:
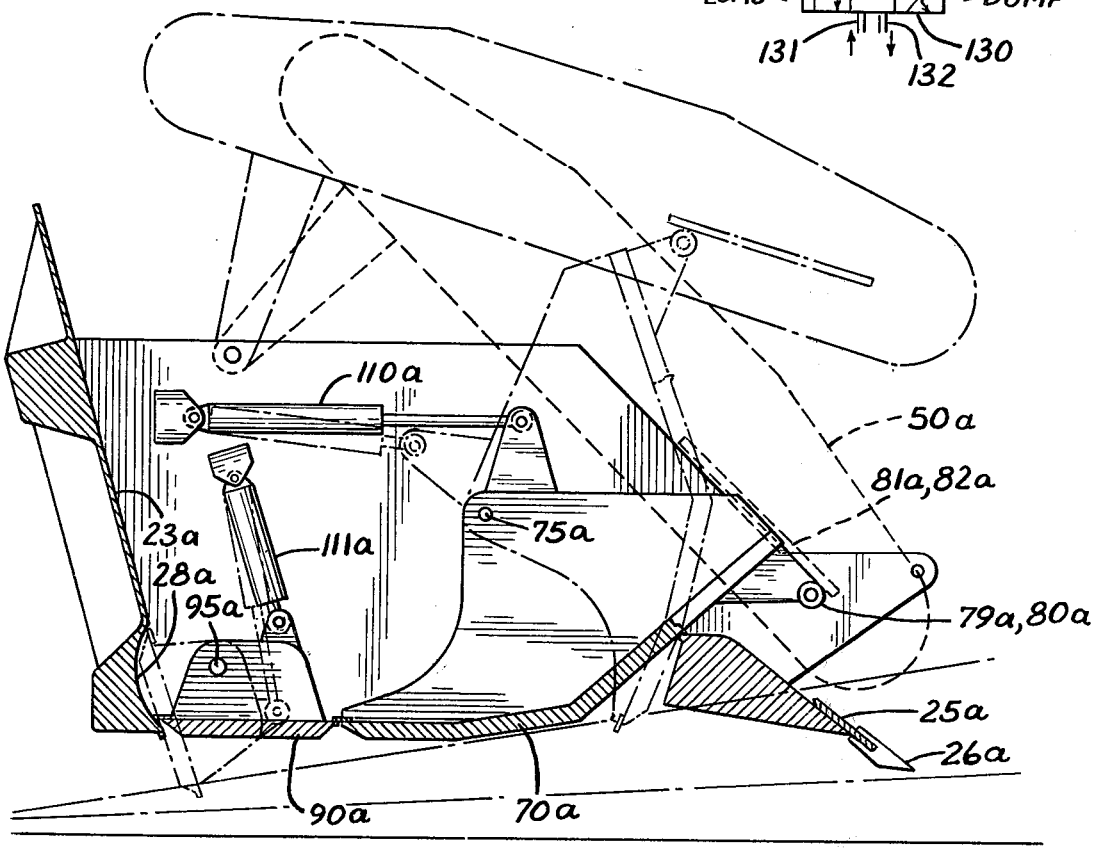
FIG. 9 is a longitudinal section similar to FIG. 5 and showing an alternate embodiment for use with a narrow elevator.
Figure 7:
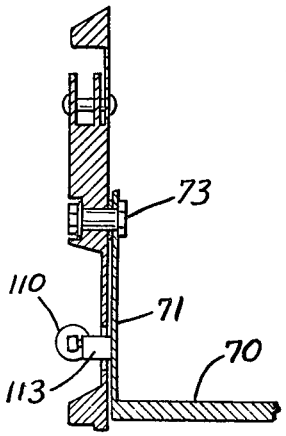
FIG. 7 is a fragmentary section taken along line 7—7 in FIG. 5.
Figure 10:
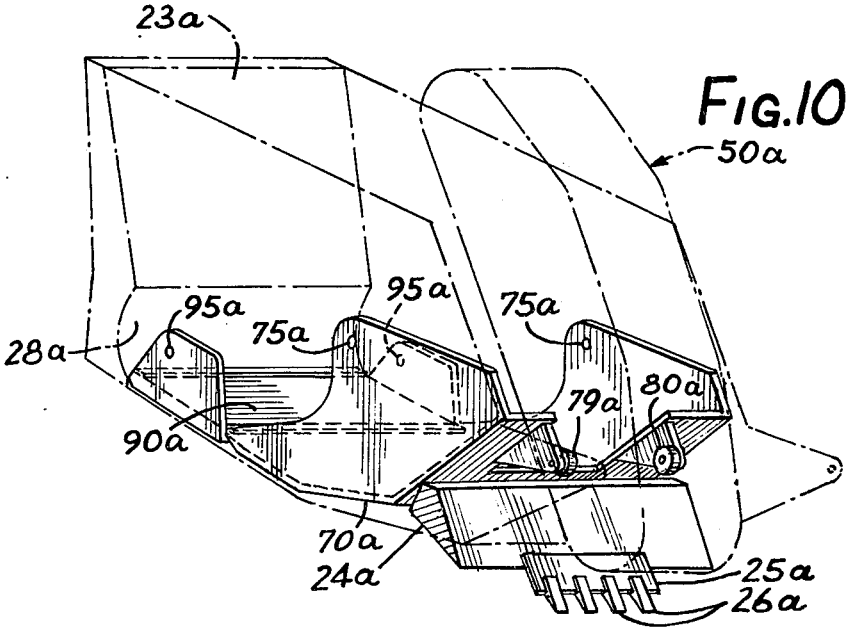
FIG. 10 is a perspective view similar to FIG. 3 but showing the front floor member of FIG. 9.

In accordance with one of the aspects of the invention, the front floor section 70 may take different forms and is particularly useful with elevators and scraper blades of relatively narrow configuration. Thus referring to FIG. 9, which shows an alternate form of floor member 70*a* the elevator and scraper blade occupy only a central portion of the floor width, the front edge of the floor being cut out (see FIG. 10) to provide an opening 76*a* defined by wing sections 77*a*, 78*a* which straddle the elevator during normal operation. The wings carry respective brackets having rollers 79*a*, 80*a* which engage tracks 81*a*, 82*a* on the elevator frame structure for automatic raising of elevator (dot-dash portion, FIG. 9). The wings, by filling in the space on each side of the elevator, prevent leakage, especially of free-running materials. In addition, the wings facilitate the collecting and dumping of soil of clayey consistency, reducing non-productive build-up of the soil above the blade base. Even where the elevator is narrow, and the cut narrow and deep, strike-off, by member 90*a*, occurs full-width. The floor sections are actuated by separate actuators 110*a*, 111*a* connected in parallel.

Figure 11:
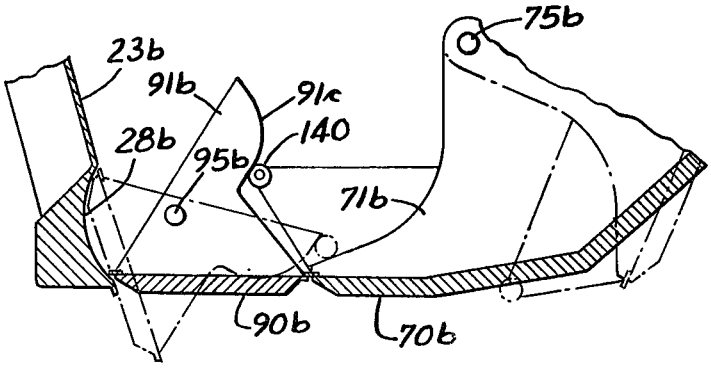
FIG. 11 is a longitudinal section illustrating use of camming action between the floor members.

While it is preferred to act upon both of the floor members directly by means of actuators, it is a feature of the invention in one of its aspects that only the front floor member, indicated at 70*b* in FIG. 11, need be power actuated and may serve, by means of a cam and cam follower, to operate the rear floor member 90*b*. Thus the end plates on the rear floor member may be profiled as shown at 91*b* presenting an arcuate edge 91*c* which is engaged by a roller 140 mounted on side plate 71*b* of floor member 70*b*.

In opening the floor, actuator 110*b* produces counterclockwise rotation of the front floor member, retracting the roller 140 permitting the rear floor member 90*b* to drop into striking position where it is securely held by soil reaction. Subsequently, when the front floor member is rotated clockwise back into its closed position, the roller 140 thereon engages the arcuate surface 91*c* as indicated by the dotted lines in FIG. 11, causing the floor member 90*b* to be cammed back into closed position.

It will be apparent that the structure amply fulfills the objects set forth. The floor mechanism is simple and foolproof, producing prompt and reliable dumping of all types of soil, without the complication of an ejector plate and with the bowl, on the contrary, being of rigid self-reinforced construction. There is no need to provide tracks and rollers with their attendant problems, and the only moving parts, the pivots and actuators, are in elevated position protected from possible damage. The floor members and their side plates together form durable, self-reinforcing cradles, free of any cocking tendency. The striker blade, located at the very rear end of the bowl, produces even, full-width leveling regardless of the width or nature of the scraper blade.

The problem of a load of soil being thrust forwardly into the elevator, and being compressed between the elevator flights and within the triangular space under the elevator, is completely overcome by the lack of an ejector, by the upward swinging disengagement of the elevator and by the swinging of the supporting floor and wing surfaces into a vertical, dumping position. Since the scraper blade forms a stationary part of the bowl structure, and is not mounted at the leading edge of the front floor member, limited movement of the elevator suffices to "clear" the elevator catenary for accommodation of the floor member.

Also since there is no necessity for accommodating the floor members in a telescoped or stacked relation, floor clearance above ground may be minimized thereby increasing carrying capacity and lowering the center of gravity. This also enables the downward projection of the striker blade, in its operating position, to be minimized, so that the rear floor member need not be heavily constructed. The amount of projection of the striker blade is also minimized by reason of the fact that the blade, being located at the very rear edge of the bowl and closely adjacent the rear axle, remains in a low position even though the bowl may be tilted upwardly at a rather sharp angle for clearance of the ripper teeth at the front end of the bowl, with the rear wheels serving as accurate gauging wheels.

The structure described above may be used with scrapers of all types but is particularly suited for scrapers having a rear driving engine since the entire space behind the bowl, and between the rear wheels, is uncluttered for mounting of the driving engine and accessories.

It is one of the features of the construction described above that the striker blade, being integral with the front edge of the rear floor member, occupies its extended position only during the time that dumping is actually taking place. During all other times, and particularly during the loading phase, the striker blade occupies a horizontal upwardly-tucked position in which it is safely out of the way of any ground obstructions which may be encountered. Nevertheless, the invention is not limited to this and, if desired, the striker blade may rigidly be secured, in downwardly projecting position, along the rear edge of the bowl, with the rear floor member being capable of swinging upwardly above the level of the striker blade so that the latter may perform its function.

Figure 3:
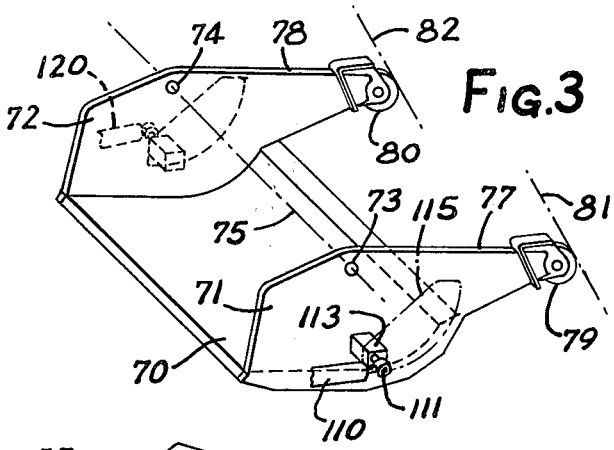
FIG. 3 is a perspective view of the front floor member.

Also while it is preferred to use a back wall which is not only rigid but fixed in position between the side plates for reasons stated, the invention is not limited to use of a fixed back wall and such fixing may be considered optional in devices where the distinctive forward portion of the structure is employed. Thus the front swingable floor section, either in the version shown in FIG. 3 or the revision shown in FIG. 10 may if desired by used to uncover a discharge opening in a bowl of the well known type having a fixed rear floor section and ejector plate. In such event a pivoted type strike-off member may be used hinged directly to the front edge of the fixed floor section and having provision for movement into striking position, by means discussed above, incident to forward swing of the front floor section.

The term "upwardly" as used herein is a relative term, and the term "horizontal" will be taken to mean generally horizontal. Similarly, the term "edge-to-edge" includes elements which are arranged substantially edge-to-edge, and the term "straight" contemplates any element which is sufficiently straight to efficiently perform its intended function.

What is claimed is:

1. In an elevating type scraper for earthmoving purposes, the combination comprising an open-fronted bowl formed of a pair of spaced vertical side sheets and a fixed back wall, ground wheels for supporting the bowl and mounted behind the back wall, a scraper blade extending between the side sheets at the front edge thereof, a tractor-supported draft frame, a pair of draft members pivotally secured at their rear ends to the side sheets and extending forwardly and upwardly having rigid connection at their front ends to the draft frame, means including an actuator interposed between the draft frame and the front end of the bowl and having control means for determining the degree of tilt of the bowl about its supporting wheels and hence the depth of cut of the blade, a driven endless elevator positioned at the front end of the bowl having its lower end in proximity to the blade and inclined upwardly and rearwardly for conveying loosened soil from the blade into the bowl, a front floor member and a rear floor member, the members being arranged edge to edge for enclosing the bottom of the bowl between the blade and the rear wall, with each of the floor members extending transversely so as to bridge the space between the side sheets, each of the floor members being in the form of a cradle having a pair of side plates secured to the lateral ends thereof and arranged flatly adjacent and within the respective side sheets, front and rear means for pivoting the side plates to the side sheets so that each floor member is pendulously supported for fore-and-aft swinging movement about a transversely extending axis, actuator means coupled to the floor members for moving them between closed and open positions, the front pivot means being so located that when the front floor member is swung forwardly to open position it nests in a generally vertical position adjacent the lower end of the elevator, the rear pivot means being so located that when the rear floor member is swung rearwardly to open position it nests in a generally vertical position adjacent the rear wall of the bowl so that substantially the entire bottom area of the bowl is available for dumping of the material in the bowl, the rear floor member having an associated straight striker blade extending substantially the width of the bowl and projecting downwardly from the bowl along the rear edge thereof to a strike-off position when the rear floor member is in its open position for leveling the material dumped from the bowl.

2. The combination as claimed in claim 1 in which the actuator means includes a pair of actuators connected between the side plates at the respective sides of the bowl with movement of the actuators serving to swing the floor members toward and away from one another into closed and open positions.

3. The combination as claimed in claim 2 in which the actuators are positioned at the outside surfaces of the side sheets with respective generally arcuate clearance openings being provided in the side sheets for connecting the ends of the actuators to the respective side plates of the floor members.

4. The combination as claimed in claim 1 in which the side plates of the floor members are of generally sector shape continuously attached along their lower edges to the lateral edges of the floor members and covering, during the course of swinging movement, a substantial portion of the bowl side plate area so that when the floor members are swung to open position the sides of the load are sheared from the side plates to facilitate movement of the load downwardly through the bottom of the bowl free of endwise compaction.

5. The combination as claimed in claim 1 in which the elevator is mounted for broadwise upward and forward swinging movement and in which means are provided for engaging the elevator as the front floor member is swung forwardly and upwardly thereby to swing the elevator out of the way of the front floor member with simultaneous disengagement of the elevator from the material in the bowl so that the material in the bowl is free for dumping.

6. The combination as claimed in claim 5 in which the front floor member is provided along its forward edge with camming means and in which the elevator is provided with cam follower means with engagement between the two serving to cam the elevator forwardly and upwardly when the floor member is swung to open position.

7. The combination as claimed in claim 1 in which the front floor member is substantially larger than the rear floor member and in which the actuating means is in the form of actuators secured to the front floor member, the floor members being mechanically coupled together so that swinging movement of the front floor member to closed position automatically moves the rear floor member to its closed position.

8. The combination as claimed in claim 7 in which cams are provided on the front floor member and cam followers are provided on the rear floor member so that the rear floor member is cammed shut when the front floor member is moved by the actuators to closed position.

9. The combination as claimed in claim 1 in which the striker blade is integrally secured to the front edge of the rear floor member, the rear wall being integrally secured to the side sheets, and a transversely extending stop surface at the lower edge of the rear wall and positioned below the axis of the rear floor member for blocking the rearward swing of the floor member and for withstanding horizontal reaction force on the striker blade as the blade levels the dumped material.

10. The combination as claimed in claim 1 in which the scraper blade is mounted upon a transversely-extending blade base rigidly secured at its ends to the side sheets, the front floor member being of generally arcuate shape having, in closed position, a first portion which is generally horizontal and a second portion which extends upwardly and forwardly over the blade base.

11. The combination as claimed in claim 1, the scraper blade and elevator being narrower than the front floor member and the front floor member being centrally cut out to accommodate the elevator and the soil which is propelled by the elevator.

12. The combination as claimed in claim 10 in which the front floor member has lateral wing portions along its front edge defining a notch between them dimensioned to receive the elevator when the latter is in normal operating position, and brackets on the wing portions for engaging the frame of the elevator for moving the elevator upwardly to an out-of-the-way position thereby to accommodate the front floor member under the elevator when the front floor member is swung to open position.

13. In an elevating type scraper for earth moving purposes, the combination comprising an open-fronted bowl formed of a pair of spaced vertical side sheets and a fixed back wall, ground wheels for supporting the bowl and mounted behind the back wall, a scraper blade in a position extending between the side sheets at the front edge thereof, a tractor-supported draft frame, a pair of draft members pivotally secured at the rear ends to the side sheets and extending forwardly and upwardly for rigid connection at their front ends to the draft frame, bowl actuator means coupled to the front end of the bowl for selectively supporting it with respect to the draft frame so that the scraper blade cuts into the ground at a predetermined level, a front floor member and a rear floor member, the members being arranged edge to edge for enclosing the bottom of the bowl between the blade and the back wall with each of the floor members extending transversely so as to bridge the space between the side sheets, means for mounting the front floor member for movement forwardly into open position, actuator means for the floor members, the rear floor member being of cradle construction having a pair of side plates arranged flatly adjacent and within the respective side sheets, the side plates being respectively pinned to the side sheets along a transverse axis so that the rear floor member is pendulously supported for fore-and-aft swinging movement between a horizontal closed position and a substantially vertical open position in which the floor member nests adjacent the rear wall of the bowl with the front edge of the rear floor member projecting downwardly from the bowl, the front edge of the rear floor member having thereon a straight striker blade extending the width of the bowl, and a bottoming stop arranged in the path of movement of the rear floor member for supporting the rear floor member against the soil reaction force of the striker blade for leveling of the material dumped from the bowl.

14. The combination as claimed in claim 13 in which the bottoming stop is at the underside of the bowl along the rear edge thereof at the bottom of the back wall and extending substantially the width of the bowl parallel to and closely adjacent the striker blade so that the force of soil reaction of the striker blade is transmitted directly to the stop with minimum imposition of reaction load to the remainder of the rear floor member and side plates thereof.

15. The combination as claimed in claim 13 in which the rear floor member is relatively so constructed and arranged as to provide less resistance to the actuator means than the front floor member and has such mechanical advantage during opening movement that the rear floor member opens to interpose the striker blade in striking position before any substantial amount of material is dumped by opening of the front floor member.

16. The combination as claimed in claim 13 in which the striker blade is shiftably mounted on the strike-off member to vary the degree of extension of the striker blade thereby to adjust the striking depth.

17. In an elevating type scraper for earth moving purposes, the combination comprising an open-fronted bowl formed of a pair of spaced vertical side sheets and a rigid back wall, ground wheels for supporting the bowl and mounted behind the back wall, a scraper blade having a blade base extending between the side sheets at the front edge thereof and rigidly secured to the latter, a tractor-supported draft frame, a pair of draft members pivotally secured at their rear ends to the side sheets and extending forwardly and upwardly for rigid connection at their front ends to the draft frame, bowl actuator means coupled to the front end of the bowl for selectively supporting it with respect to the draft frame so that the scraper blade cuts into the ground at a predetermined level, a driven endless elevator positioned at the front end of the bowl having its lower end in proximity to the blade and inclined upwardly and rearwardly for conveying loosened soil from the blade into the bowl, a front floor member adjacent the blade base and extending rearwardly thereof bridging the space between the side sheets, the front floor member being in the form of a cradle having a pair of side plates secured to the lateral ends thereof and arranged flatly adjacent and within the respective side sheets, means for pivoting the side plates to the side sheets so that the floor member is pendulously supported for fore-and-aft swinging movement about an elevated transversely extending axis, the pivot means being so located that when the front floor member is swung forwardly to open position it nests in a generally vertical position adjacent the lower end of the elevator, a pivoted strike-off member extending transversely along the rear edge of the bowl to bridge the space between the side sheets, the strike-off member carrying a striker blade along its front edge and serving when in a closed horizontal position to enclose the bottom of the bowl rearwardly of the front floor member, actuator means for swinging the front floor member and strike-off member from a horizontal position in which they enclose the bottom of the bowl to respective vertical positions in which substantially the entire area of the bottom of the bowl is uncovered for dumping the load therefrom, and stop means arranged in the path of movement of the strike-off member for positioning the strike-off member at a predetermined striking angle in the face of soil reaction.

18. In an elevating type scraper for earth moving purposes, the combination comprising an open-fronted bowl formed of a pair of spaced vertical side sheets and a rigid back wall, ground wheels for supporting the bowl and mounted behind the back wall, a scraper blade extending between the side sheets at the front end thereof, a tractor-supported draft frame, a pair of draft members pivotally secured at their rear ends to the side sheets and extending forwardly and upwardly for rigid connection at their front ends to the draft frame, bowl actuator means coupled to the front end of the bowl for selectively supporting it with respect to the draft frame so that the scraper blade cuts into the ground at a predetermined level, a driven endless elevator positioned at the front end of the bowl having its lower end in proximity to the blade and inclined upwardly and rearwardly for conveying loosened soil from the blade into the bowl, a front floor member adjacent the blade base and extending rearwardly thereof bridging the space between the side sheets, the front floor member being in the form of a cradle having a pair of side plates secured to the lateral ends thereof and arranged flatly adjacent and within the respective side sheets, means for pivoting the side plates to the side sheets so that the floor member is pendulously supported for forward swinging movement about an elevated transversely extending axis into a position to uncover a discharge opening, the scraper blade and elevator being narrower than the front floor member and the front floor member being centrally cut out to accommodate the elevator and the soil which is propelled by the elevator, and a strike-off member extending transversely full-width between the side sheets and pivoted with respect thereto at the rear of the discharge opening.

19. In an elevating type scraper for earth moving purposes, the combination comprising an open-fronted bowl formed of a pair of spaced vertical side sheets and a back wall, ground wheels for supporting the bowl and mounted behind the back wall, a scraper blade having a blade base extending between the side sheets at the front edge thereof and rigidly secured to the latter, a tractor-supported draft frame, a pair of draft members pivotally secured at their rear ends to the side sheets and extending forwardly and upwardly for rigid connection at their front ends to the draft frame, bowl actuator means coupled to the front end of the bowl for selectively supporting it with respect to the draft frame so that the scraper blade cuts into the ground at a predetermined level, a driven endless elevator positioned at the front end of the bowl having its lower end in proximity to the blade and inclined upwardly and rearwardly for conveying loosened soil from the blade into the bowl, a front floor member adjacent the blade base and extending rearwardly thereof bridging the space between the side sheets, the floor member being in the form of a cradle extending between the side sheets for normally enclosing the bottom of the bowl, the floor member being pivoted for fore-and-aft swinging movement about an elevated transversely extending axis so located that when the floor member is swung forwardly to open position it clears the blade base and nests in a generally vertical position adjacent the lower end of the elevator, a strike-off member positioned rearwardly of the front floor member and extending full width between the side sheets, means for moving the strike-off member into a downwardly extended position for leveling the discharged soil when the floor member is in open position, and actuator means for swinging the floor member between its enclosing and opening positions.

20. The combination as claimed in claim 19 in which the front floor member has a horizontal portion and front portion which extends upwardly and forwardly over the blade base, the front portion having a rectangular notch formed therein flanked by wing portions, the elevator being substantially narrower than the bowl for registered reception in the notch under normal scraping conditions, the wing portions extending laterally from the elevator to close the space between the elevator and the side sheets thereby to prevent leakage of loose soil around the elevator from the bowl.

21. The combination as claimed in claim 19 in which a cam and cam follower are interposed between the floor section and elevator so that the elevator is swung upwardly to an out-of-the-way position incident to forward swing of the floor section.

22. The combination as claimed in claim 19 in which the strike-off member is pivoted for swinging movement between horizontal and vertical positions and coupled to the floor member for movement in step therewith.

23. The combination as claimed in claim 19 in which the strike-off member has a striker blade rigidly secured to the member in a plurality of selectable positions for gross adjustment of striking depth with the rear wheels serving as gauge wheels and with intermediate adjustment being secured by control of the bowl actuator means.

* * * * *